US007574810B1

(12) United States Patent
LoRocco

(10) Patent No.: US 7,574,810 B1
(45) Date of Patent: Aug. 18, 2009

(54) ILLUMINATED REFLECTIVE SIGHTING DEVICE

(75) Inventor: Paul LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 92 days.

(21) Appl. No.: 11/458,333

(22) Filed: Jul. 18, 2006

(51) Int. Cl.
*F41G 1/467* (2006.01)

(52) U.S. Cl. ..... 33/265; 124/87; 42/132

(58) Field of Classification Search ..... 33/265, 33/286, DIG. 21; 124/87; 42/123, 131, 132
See application file for complete search history.

(56) References Cited

U.S. PATENT DOCUMENTS 3,121,163 A * 2/1964 Rickert ..... 250/467.1
3,234,651 A 2/1966 Rivers
3,368,282 A * 2/1968 Gibson et al. ..... 33/265
3,951,553 A * 4/1976 Oberheuser ..... 356/251
4,120,096 A 10/1978 Keller
4,576,451 A * 3/1986 Tominaga ..... 359/428
5,065,520 A * 11/1991 Shimizu et al. ..... 42/123
5,086,567 A 2/1992 Tutsch
5,090,805 A 2/1992 Stawarz
5,131,153 A 7/1992 Seales
5,189,555 A * 2/1993 Jorlov ..... 359/618
5,205,044 A * 4/1993 DePaoli ..... 42/132
5,339,227 A * 8/1994 Jones ..... 362/109
5,383,278 A * 1/1995 Kay ..... 33/265
5,394,615 A * 3/1995 Hoppe et al. ..... 33/265
5,634,278 A 6/1997 London
5,653,034 A * 8/1997 Bindon ..... 42/131
5,924,234 A * 7/1999 Bindon et al. ..... 42/123
6,154,971 A 12/2000 Perkins
6,397,483 B1 6/2002 Perkins
6,807,742 B2 10/2004 Schick et al.
7,331,113 B1 * 2/2008 Patrick et al. ..... 33/286

* cited by examiner

*Primary Examiner*—Amy Cohen Johnson
(74) *Attorney, Agent, or Firm*—Alvin R. Wirthlin

(57) ABSTRACT

An illuminated sighting device includes a reflective sight component mounted within a sight window. Light emitting elements are vertically arranged for projecting vertically stacked sight points or dots onto a reflective surface of the sight component which can be superimposed on a distal target during aiming. The light emitting elements may be one or more light collector ends and/or one or more separate light sources such as LED's.

28 Claims, 10 Drawing Sheets

ILLUMINATED REFLECTIVE SIGHTING DEVICE

BACKGROUND OF THE INVENTION

This invention relates generally to sighting devices for archery bows, firearms, or other projectile launching devices, and more particularly to an illuminated sighting device having reflective sight dots for superimposing on a target during aiming.

Reflex sights typically include a partially reflective lens and a battery-powered light source that projects light onto the reflective lens to define a reticule or reflex dot which is superimposed on a target as viewed through the lens. The reticule in these types of sights tends to obscure large areas of the target at longer ranges, may be marginally visible in bright daylight conditions, and too bright in lower light conditions. Additionally, since such sights typically have a single reticule that must be adjusted on the fly for different target distances, the user's ability to quickly superimpose the reticule on a target at varying distances is limited.

In an effort to overcome these problems, several improvements have been proposed. By way of example, U.S. Pat. No. 5,924,234, and U.S. Pat. No. 5,653,034 disclose reflex sights with either a fluorescent-doped fiber optic or light pipe that receives ambient light along its length and transmits that light to its ends. Light projecting from one of the ends is incident on a lens as a reflex dot or reticule that can be superimposed on a target. With this arrangement, the light intensity of the reflex dot is directly dependent on the ambient light level. However, due to their complicated shape, the fiber optics can be difficult to manipulate, shape and position on the sight housing, leading to increased manufacturing time and expense. Again, such sights only provide a single reflex dot and therefore limit the user's ability to quickly position the dot on a target at varying distances.

Other non-reflex sights have been proposed with multiple vertically stacked sight points. However, many of these sights unduly obscure a user's view of the target and/or may not be separately adjustable to accommodate a user's particular bow, arrow type, and shooting style for varying target distances or heights. Some of these vertically stacked sights are not illuminated and therefore may be difficult to use in low light conditions. In addition, such sights also require a separate peep sight or the like to maintain consistency in bow orientation with respect to the shooter from shot to shot. It would therefore be desirable to provide an illuminated reflective sighting device that overcomes at least some of the disadvantages of the prior art.

BRIEF SUMMARY OF THE INVENTION

According to one aspect of the invention, an illuminated sighting device includes a reflective sight component having a reflective surface for facing a user, and first and second light emitting elements arranged for projecting first and second sight dots, respectively, onto the reflective surface for view by a user during aiming. The first and second light emitting elements are approximately equally spaced from the reflective surface.

According to a further aspect of the invention, an illuminated sighting device includes a reflective sight component with a reflective surface for facing a user; and at least one light emitting element arranged for projecting at least one sight dot onto the reflective surface for view by a user during aiming. A width of the reflective surface is approximately equal to a width of the incident sight dot so that at least a substantial portion of the sight dot can viewed by the user when the sighting device is properly aligned with the user.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict exemplary embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
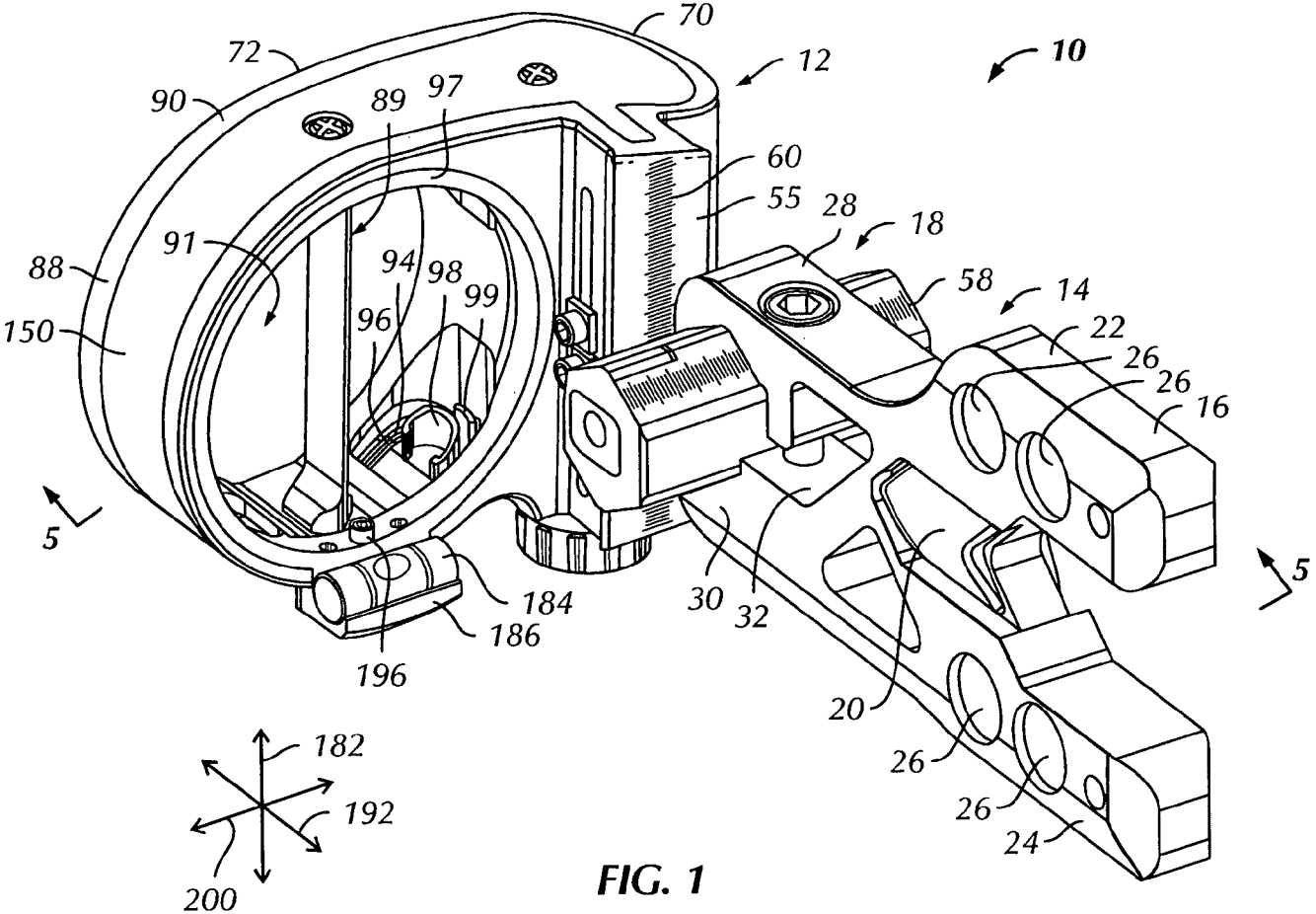
FIG. 1 is a left rear perspective view of an illuminated sighting device in accordance with the present invention.

Referring to the drawings, and to FIG. 1 in particular, an illuminated sighting device 10 in accordance with the present invention is illustrated. The sighting device 10, as shown throughout the drawings, is embodied as a bowsight. To this end, the sighting device 10 is provided with a sight assembly 12 and a bracket assembly 14 for attaching the sight assembly to a bow (not shown) or the like. However, it will be understood that the sighting device 10 may be adapted for use with a particular projectile launching device such as a rifle, pellet gun, BB gun, pistol, paint marker, and the like, and can be used with other devices, such as telescopes, sighting scopes, and so on, in order to quickly align the device with a distal target or scene.

With additional reference to FIGS. 2-5, the bracket assembly 14 preferably includes a mounting bracket 16 connected to an adjustment mechanism 18 for adjusting both the lateral and vertical positions of the sight assembly 12. By way of example, it may be necessary to adjust the lateral position of the sight assembly 12 when used during windy conditions. Likewise, vertical adjustment of the entire sight assembly 12 may be needed when initially calibrating the sighting device 10 with a particular bow or other device, when changing from one arrow type to another, when shooting from different heights, such as from the ground or a tree stand, and so on.

The bracket 16 has a main body portion 20 with a pair of spaced legs 22, 24 extending rearwardly therefrom. A pair of openings 26 are formed in each leg for receiving a fastener (not shown) or the like to mount the sighting device 10 to a bow (not shown) in a conventional manner. The bracket 16 also includes a pair of opposing jaws 28, 30 that extend forwardly from the main body portion 20 and normally clamp around a tubular adjustment member 40. A slot 32 is formed in the body portion 20 to allow movement of the jaws toward and away from each other. A bolt 34 extends through an opening 36 in the jaw 28 and into a threaded opening 38 in the jaw 30. Preferably, rotation of the bolt 34 in a clockwise direction draws the jaws toward each other to clamp the tubular member 40 at a desired position while rotation of the bolt in a counter-clockwise direction causes the jaws to move away from each other for adjusting the position of the tubular member with respect to the bracket 16.

Figure 8:
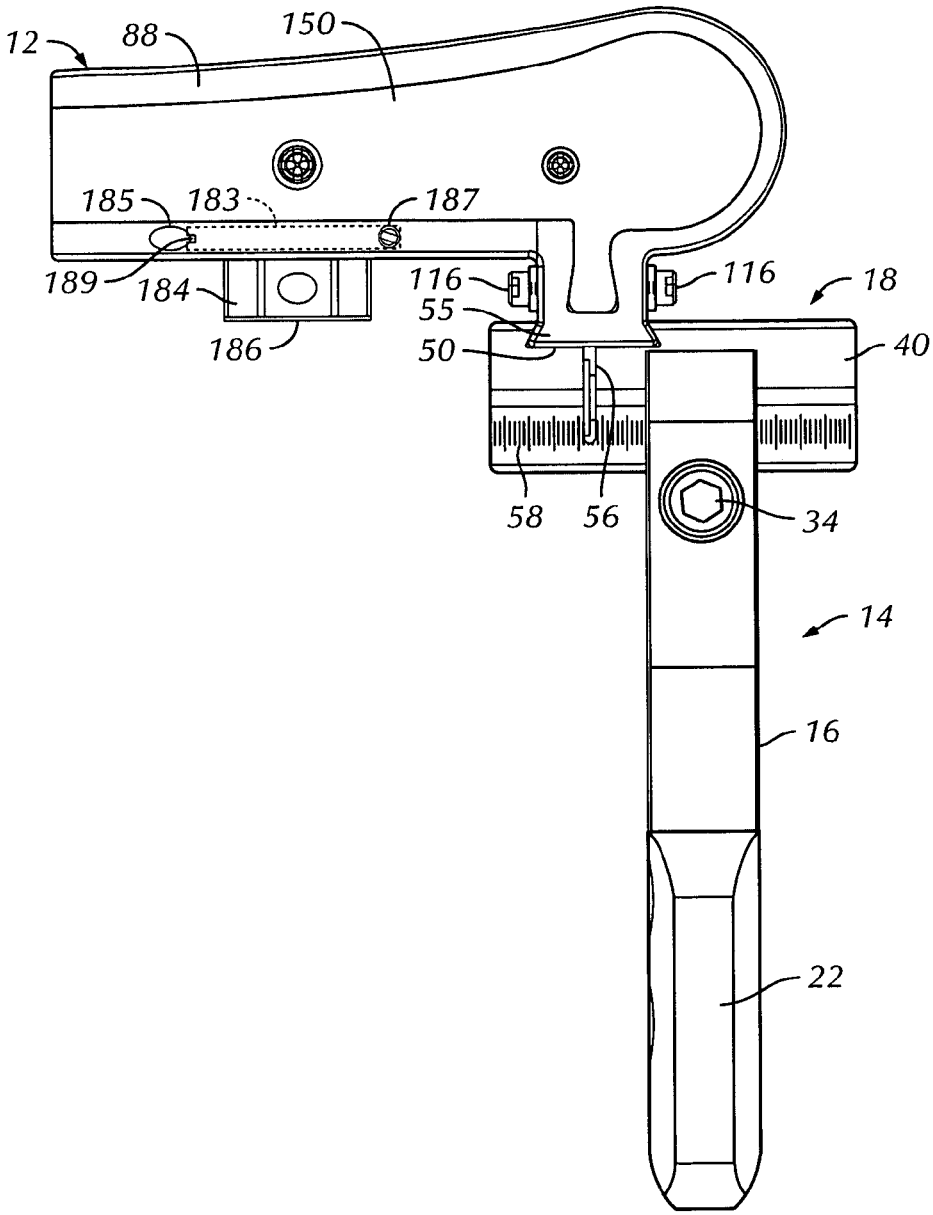
FIG. 8 is a top plan view of the FIG. 1 sighting device.

The adjustment mechanism 18 includes the tubular member 40 with a base 42, an adjustment nut 44 received within an elongate opening 46 of the base, and a bolt 48 that extends through the tubular member 40 and threads into the adjusting nut. The tubular member 40 has a dovetail-shaped groove 50 with sides 52, 54 that function as opposing jaws to receive a corresponding dovetail-shaped projection 55 of the sighting assembly 10, as best shown in FIG. 8. A slot 56 is formed in the tubular member 40 and across the groove 50. Preferably, rotation of the bolt 34 in a clockwise direction draws the jaws toward each other to clamp the dovetail-shaped projection 55 in a desired position while rotation of the bolt in a counter-clockwise direction causes the jaws to move away from each other for adjusting the vertical height of the sight assembly 12. A windage scale 58 may be provided on the tubular member 40 while a height scale 60 may be provided on the dovetail-shaped projection 55.

Referring now to FIGS. 1, 2 and 5-7, the sight assembly 12 preferably includes a housing portion 70 and a sight portion 72 connected to the housing portion, preferably with bolts 74 that extend through vertically spaced openings 76 (only one shown in FIG. 2) formed in a side wall 80 of the housing portion and into threaded openings 78 located within a vertically oriented groove 82 of an opposing side wall 84 of the sight portion 72. The side wall 80 has a vertically oriented projection 86 that fits into the groove 82 of the sight portion 72 so that the housing and sight portions are properly aligned during assembly. It will be understood that the sight and housing portions can be connected together through other fastening means, such as welding, heat staking, adhesive bonding, and so on. It will be further understood that the housing and sight portions can alternatively be formed as a single integral unit during machining, molding, and so on.

The sight portion 72 also includes a sight frame 88 extending from the wall 84 and a primary reflective sight component 89 mounted to the sight frame. The sight frame 88 preferably has an annular wall 90 that forms a sight window 91 through which the reflective sight component 89 and a distal target can be viewed. Preferably, the reflective sight component 89 is mounted to the sight frame within the sight window 91. A outer circular channel 92 is formed in the wall 90 for receiving a pair of light collectors 94, 96 that function as a light source to reflect light onto the reflective sight component 89, as will be described in greater detail below. Elongate, curved openings 93 and 95 can be provided in the sight frame 88 to both reduce the weight of the sighting device 10 and allow additional light to impinge on the light collectors located within the channel 92. This is especially advantageous when the frame is constructed of an opaque material. However, it will be understood that the openings may also be provided when the frame is constructed of a translucent or transparent material. If desired, a ring 97 with reflective or light enhancing qualities may be provided on a rear surface of the sight frame 88 to enhance the outer boundary of the sight window 91 during low light conditions.

Each light collector 94, 96 is preferably constructed of a fluorescent-doped fiber optic or the like. A suitable fluorescent-doped fiber optic may be constructed of a polystyrene-based core containing one or more fluorescent dopants that is surrounded by a polystyrene, polymethyl methacrylate, or fluoropolymer cladding. When such a fiber optic receives radiation along its length, energy is absorbed in the fiber optic at a certain wavelength and is re-emitted at both ends of the fiber optic at a longer wavelength. Thus, depending on the amount of radiation absorbed by the fiber optic along its length, a proportionate amount of radiation is emitted at the ends of the fiber optic. Although the fiber optic is preferably circular in cross section, it is contemplated that other cross sectional shapes such as oval, triangular, rectangular, arcuate, etc., may be used. Moreover, it will be understood that the light collectors 94, 96 are not limited to the particular material as set forth in the exemplary embodiment. The core and cladding may be formed out of any suitable transparent or translucent materials, as long as the index of refraction of the core material is greater than the index of refraction of the cladding material. The cladding material itself may be air or other fluid surrounding at least a portion of the core.

Figure 2:
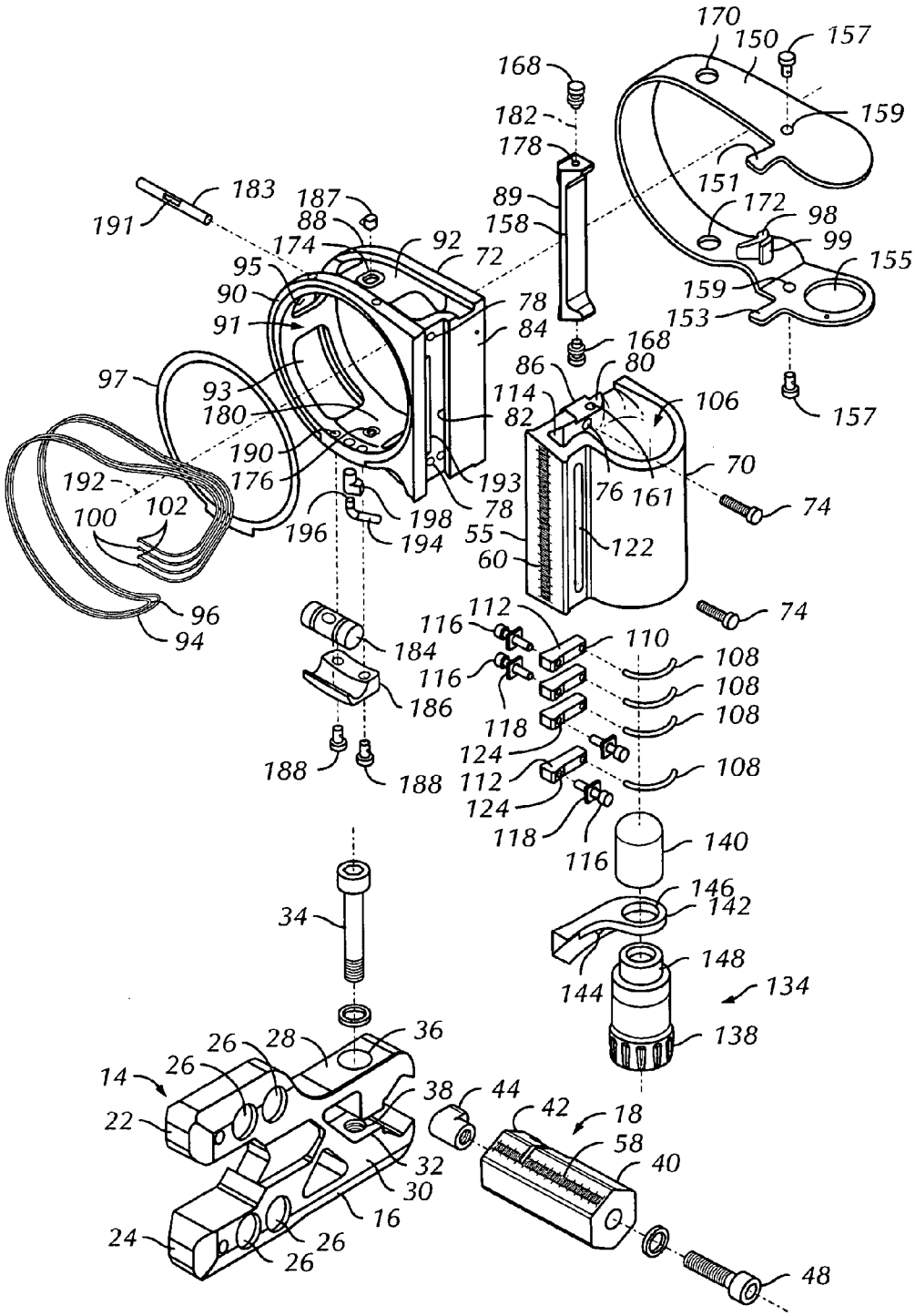
FIG. 2 is an exploded right rear perspective view of the sighting device of FIG. 1.
Figure 3:
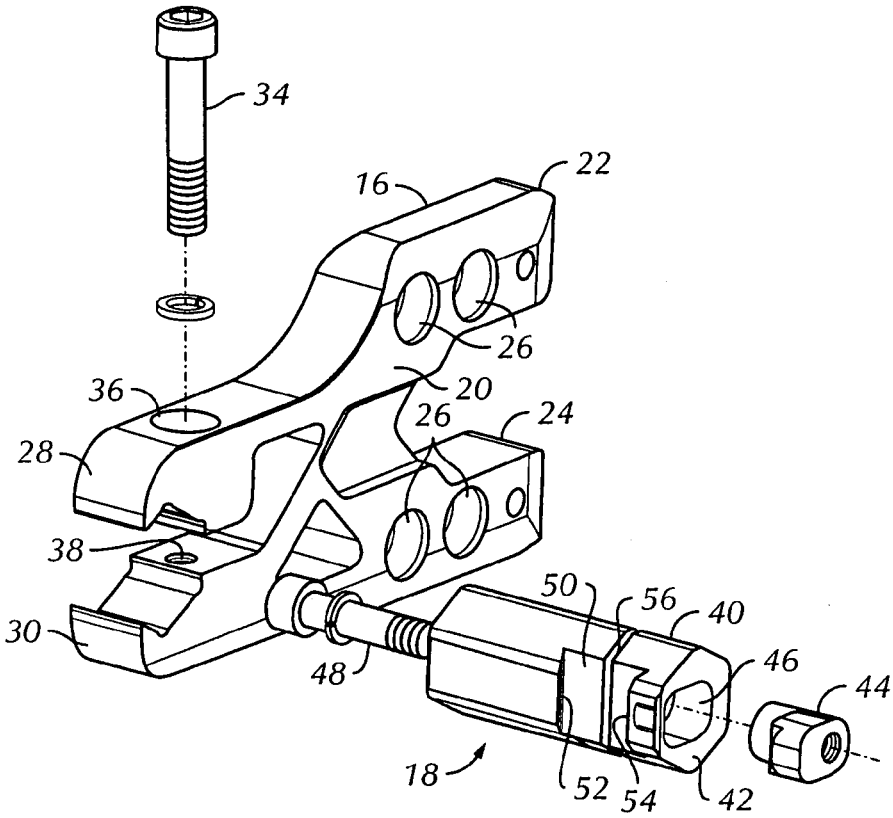
FIG. 3 is a front left perspective exploded view of a bracket assembly of the FIG. 1 sighting device.
Figure 4:
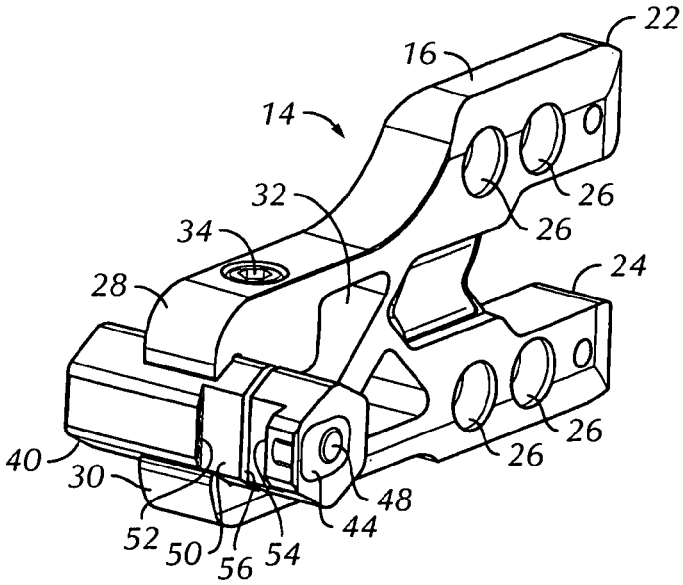
FIG. 4 is a front left perspective assembled view of the bracket assembly.
Figure 5:
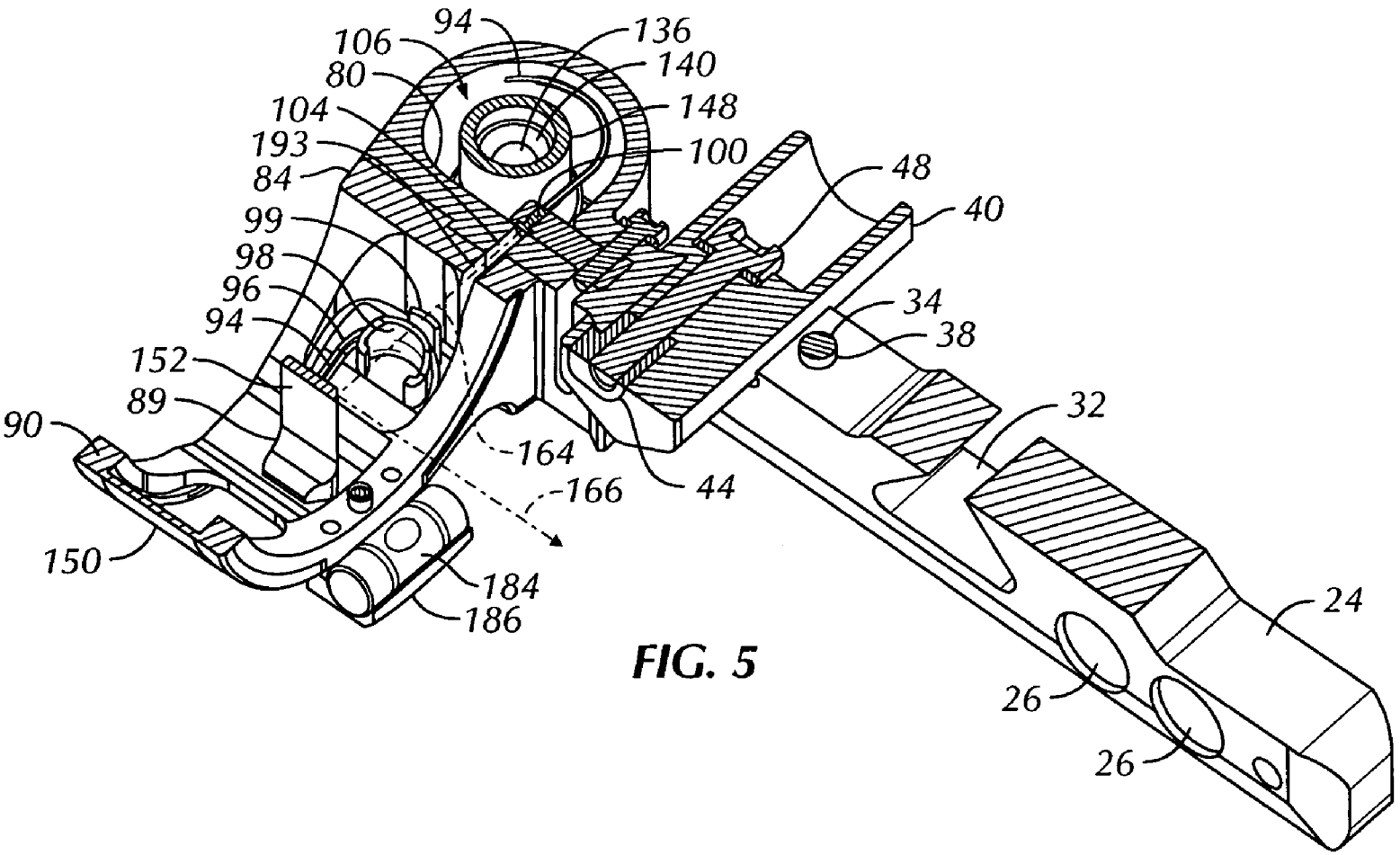
FIG. 5 is perspective sectional view of the sighting device taken along line 5-5 of FIG. 1.
Figure 7:
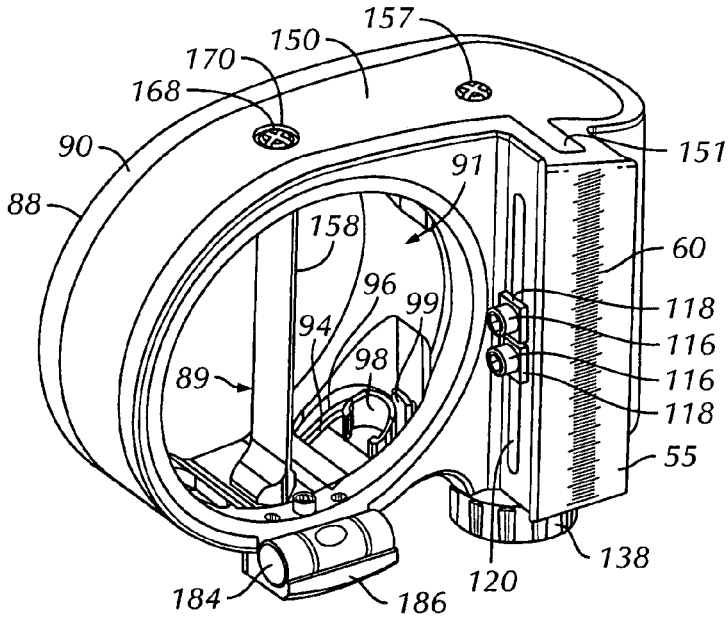
FIG. 7 is a left rear perspective view of the sight assembly.

As best shown in FIGS. 2, 5 and 7, each light collector 94, 96 preferably includes a single length of fluorescent-doped fiber optic that loops between a pair of projections 98 and 99 extending upwardly from a protective cover 150 connected to the sight frame 88 to form a pair of ends 100, 102 that terminate within a hollow interior 106 of the housing portion 70. In use, light incident on the portions of the light collectors 94, 96 located within the channel 92 is absorbed in the fiber optics and is re-emitted at the ends 100, 102 to thereby illuminate the ends.

The ends 100, 102 are coincident with a vertical slot 104 formed in the side wall 80 and are preferably adjustable along the length of the slot 104 so that a user may sight in a distal target at various distances. In order to effect adjustment, each end 100, 102 is preferably inserted through a curved, transparent tube 108 and bore 110 (FIG. 2) of an adjustment block 112. The transparent tube 108 is connected to each adjustment block for supporting the light collectors 94, 96. Each adjustment block 112 is in turn located within a vertically extending channel 114 formed by the rearwardly extending dovetail-shaped projection 55. An adjustment bolt 116 extends through either a left side vertical slot 120 (FIG. 7) or a right side vertical slot 122 (FIGS. 3 and 6) and threads into a threaded bore 124 of one of the adjustment blocks. When it is desirous to adjust the vertical position of one of the fiber optic ends 100, 102, the adjustment bolt 116 is loosened to permit sliding action of the adjustment block along its associated vertical slot 120, 122. Once properly positioned, the adjustment bolt 116 is tightened to clamp the adjustment block against a side of the dovetail-shaped projection 55. As shown, the adjustment bolt 116 may be fitted with a square washer 118 to provide additional support during tightening.

Each end 100, 102 of the light collectors 94, 96 is preferably formed with an integral lens having a diameter or cross dimension that is larger than the diameter or cross dimension of the light collector and the bore 110 of the adjustment block. In this manner, the end is anchored to the adjustment block and movable therewith while light exiting the end is distributed over a wider field of view. Enlargement of the ends 100, 102 can be accomplished by applying heat thereto, preferably after the light collector has been inserted through the bore 110 of the adjustment block 112. The illuminated ends 100, 102 form separate light emitting elements that project separate illuminated sight points or dots 126, 128, 130 and 132 (FIG. 6) onto a rearwardly facing reflective surface 158 of the reflective sight component 89. Preferably, the illuminated ends are approximately the same distance from the reflective sight component 89 so that the sight dots 126-132 are of uniform size and are approximately the same diameter or width as the width of the reflective surface 158. The separate light emitting elements may be of the same color or different colors. It will be understood that the integral lens may be eliminated and the light collector end be connected to the adjustment block through other attachment means.

Although four separate light emitting elements are shown, it will be understood that more or less light emitting elements may be provided for projecting more or less illuminated sight points onto the reflective sight component 89. It will be further understood that the light emitting elements are not limited to the ends of one or more light collectors, but may alternatively be in the form of separate light emitting diodes (LED's), incandescent bulbs, a sheet with multiple openings with a backlight for projecting light through the openings for creating the multiple sight dots, and so on.

When the light collectors 94, 96 are used, a light module 134 is preferably mounted in the hollow interior 106 of the housing portion 40 for illuminating the ends 100, 102 of the light collectors 94, 96 during very low light conditions or whenever brighter reflected sight dots are desired. The light module 134 includes a light generating element 136 (FIG. 5), preferably in the form of a single LED. An incandescent bulb, tritium light, or other artificial light source may alternatively be used. The LED is powered by a battery (not shown) and operably connected to a switch or knob 138 for turning the LED on and off. A cover 140 constructed of a transparent or translucent material is mounted over the LED so that light is evenly distributed to the portion of the light collectors 94, 96 within the housing interior 106. A bracket 142 includes an aperture 144 through which the upper bolt 74 extends for mounting the bracket to the side wall 80 of the housing portion 70. The bracket 142 also includes an opening 146 for receiving an annular wall 148 of the light module 134 to thereby mount the light module 134 to the interior 106 of the housing portion 70. The annular wall 148 may be secured to the opening 146 by friction fit, adhesive, or other attachment means.

Although for the sake of economy it is preferred that the various sections or segments of the light collector are continuous, that is to say formed of a single length of fluorescent-doped fiber optic or other light collecting material, the sections can be formed of different materials when the light module 134 is not used. For example, a first section of the light collector associated with the housing portion 72 can comprise a regular fiber optic or optical rod and a second section associated with the sight portion can comprise a light gathering fiber optic that is optically coupled with the first section so that light gathered along a length of the second section can be transmitted to the light emitting elements at the end of the first section.

The protective cover 150 is preferably constructed of a transparent material and is shaped to fit within the circular channel 92 and hollow interior 106 so that an outer surface of the cover 150 is flush with outer surfaces of the sight and housing portions. The cover 150 includes a pair of tabs 151, 153 that fit within the vertically extending channel 114 of the dovetail-shaped projection 55. An enlarged opening 155 is formed in a lower portion of the cover 150 to accommodate the light module 134. The cover 150 is attached to the sight portion 72 with screws 157 that extend through apertures 159 in the cover and threaded openings 161 (only one shown in FIG. 3) of the housing portion 70. The protective cover is not intended to be a light blocking or light intensifying member, but as a means of protecting the light collectors located within the circular channel 92 and interior 106 against damage. Although the cover 150 is shown as a separate transparent member, the cover can alternatively comprise tape or a coating or component that can be directly applied or molded to the light collectors 94, 96 within the channel 92. Where the fiber optic is constructed of a sufficiently resistant material or where damage to the fiber optic is not a concern, the protective cover 150 can be eliminated and the projections 98, 99 can be provided on the annular wall 90.

Referring now to FIGS. 2, 6, and 9-11, the reflective sight component 89 preferably comprises a blade 152 having an upper mounting head 154 and a lower mounting head 156. The rearwardly facing reflective surface 158 extends between a right side surface 160 and a left side surface 162 of the blade 152 to face a user of the illuminated sighting device 10. Preferably, the reflective surface 158 is flat or planar and comprises a highly polished metallic surface. Alternatively, the reflective surface 158 may comprise a mirror, reflective tape, a reflective coating, and so on. It will be understood that the reflective surface 158 may be curved instead of flat. The reflective surface extends at a first angle $\alpha_1$ with respect to the left side surface 162 and a second angle $\alpha_2$ with respect to a first line of sight 164 (shown in broken line) of the illuminated ends or light emitting elements 100, 102. Preferably the first and second angles are approximately 45° so that a user can view the sight dots 126-132 incident on the reflective surface 158 along a second line of sight 166 (shown in broken line) from the reflective surface. However, it will be understood that the first and second angles may be different and/or vary over a wide range of values depending on the particular sight configuration and/or the aiming stance of a user.

The reflective sight component 89 is preferably mounted to the annular wall 90 within the sight window 91 by a pair of screws 168 that extend through openings 170, 172 (FIG. 2) of the cover 150, corresponding openings 174, 176 in the channel 92 of the annular wall 90, and threaded openings 178 (only one shown) in the upper mounting head 154 and lower mounting head 156. As shown, the openings 174, 176 are preferably elongate so that the reflective sight component 89 can be adjusted forwardly or rearwardly. Also, the inner surface 180 of the annular wall 90 is preferably smooth, e.g. void of alignment slots and projections, so that the reflective sight component 89 can be rotated about its longitudinal axis 182 (as defined by the openings 178) to thereby adjust the direction of the second line of sight 166 (FIG. 11) according to the particular aiming preferences of a user. However, it will be understood that alignment slots and/or projections may be provided if angular adjustment of the reflective sight component is not needed.

Figure 6:
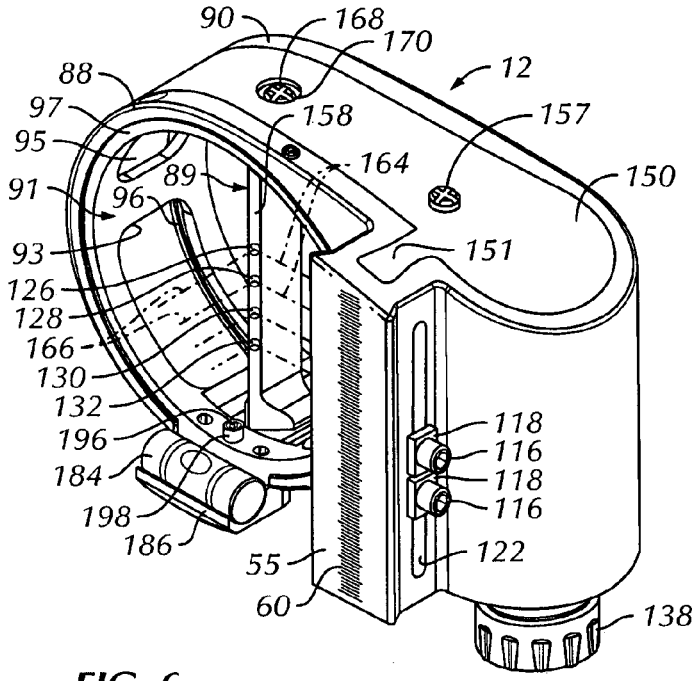
FIG. 6 is a right rear perspective view of a sight assembly of the FIG. 1 sighting device.
Figure 11:
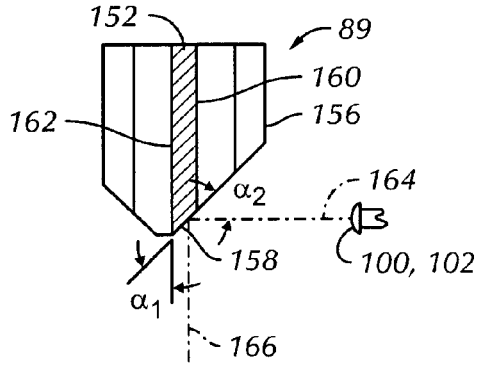
FIG. 11 is a sectional view of the reflective sight component taken along line 11-11 of FIG. 10.

In use, and as best shown in FIGS. 5, 6 and 11, light from the light emitting elements 100, 102 is projected through the vertical slot 104 of the housing portion 70 and a corresponding vertical slot 193 of the sight portion 72 along the first line of sight 164 such that separate, vertically oriented illuminated sight points or dots 126, 128, 130 and 132 (FIG. 6) are incident on the reflective surface 158 of the reflective sight component 89. In the aiming position, the incident sight dots can be viewed by a user generally along the second line of sight 166 and superimposed on a distal target. The separate light emitting elements may be of the same color or different colors to thereby produce sight dots of the same or different colors. The incident sight dots 126-132 preferably have a width that is substantially equal to the width of the reflective surface 158 between the right side surface 160 and left side surface 162. In this manner, at least a substantial portion of the sight dots are viewable on the reflective surface 158 only when the sight, and thus the bow, is consistently aligned with respect to the user during aiming about an axis parallel to the axis 182 of the reflective sight component 89. Preferably, the axis 182 is a generally vertical axis which may vary according to a user's preference to cant the bow. In addition, the relatively narrow width of the blade 152 ensures minimal obstruction of the distant target.

As shown in FIGS. 1 and 2, a bubble level 184 is connected to a lower end of the sight frame 88 via a bracket 186 that receives and holds the bubble level and a pair of screws 188 that extend through the bracket and into threaded openings 190 formed in the sight frame 88. The bubble level 186 assures consistent alignment of the bow along an axis parallel to a central axis 192 of the sight portion 72 during aiming. Preferably, the axis 192 is a generally horizontal axis.

Figure 9:
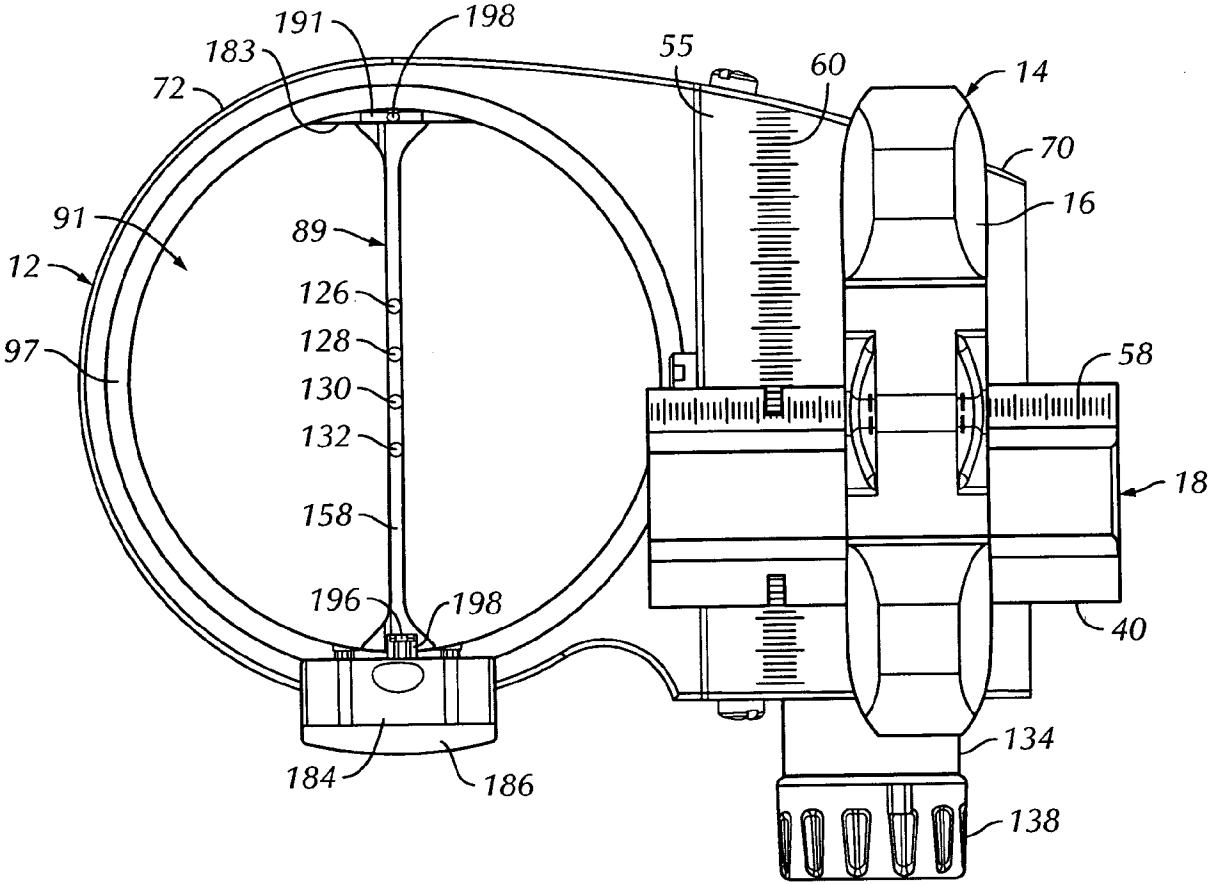
FIG. 9 is a rear elevational view of the FIG. 1 sighting device.
Figure 10:
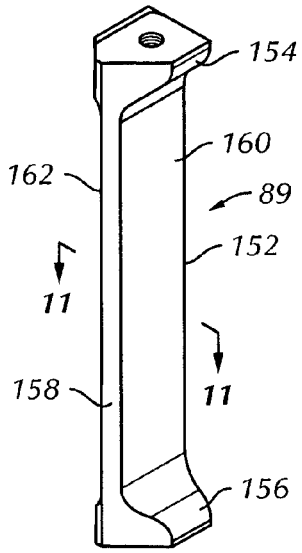
FIG. 10 is a right rear perspective view of a reflective sight component of the FIG. 1 sighting device.

As best shown in FIGS. 2, 8 and 9, a secondary reflective sight component 183 is located within a horizontal bore 185 (FIG. 8) of the sight frame 88 and fixed in place with a set screw 187. The secondary reflective sight component 183 is preferably in the form of a cylindrical rod and includes a rearwardly facing flat reflective surface 191 that is angled at approximately 45° with respect to the vertical axis 182. The cylindrical nature of the reflective sight 182 lends itself to precise angular adjustment of the reflective surface 191 with respect to a user's proper aiming stance. Accordingly, a slot 189 is formed in an end of the reflective sight 182 that can be accessed with a screwdriver or the like for effecting adjustment of the reflective sight about its longitudinal axis. However, it will be understood that the cross sectional shape of the secondary reflective sight component 183 may alternatively be square, triangular, or of any other multi-faceted or rounded shape, and that the reflective surface may be formed as one of the facets. A light collector 194 (only partially shown), preferably in the form of a fluorescent-doped fiber optic, includes an end 196 mounted in a transparent lens housing 198 at the lower end of the sight frame 88. The end 196 is illuminated when the light collector 194 is exposed to ambient light to project an illuminated alignment point or dot 198 onto the surface 191 of the secondary reflective sight component 183. Preferably, the reflective surface 191 and the alignment dot 198 are approximately the same width so that the alignment dot 198 is viewable by a user only when the bow is properly oriented about a horizontal axis 200 (FIG. 1) perpendicular to the axes 182 and 192. As with the primary reflective sight component 89, the light collector may be replaced with other light emitting elements.

The combination of the primary reflective sight component 89 and secondary reflective sight component 183 ensures that the bow is always properly oriented with respect to the user during aiming about the vertical axis 182 and horizontal axis 192, respectively, and therefore eliminates the need for peep holes and the like. Preferably, the reflective surface 191 is longer than the width of the reflective surface 158 of the reflective sight component 89 so that the sight dot 191 (FIG. 9) is viewable over a wider angle than the sight dots 126-132. In this manner, the bow can be oriented about the horizontal axis 200 independent of the orientation about the vertical axis 182. It will be understood that both the primary and secondary reflective sight components can be used together or independently. For example, the primary reflective sight component 89 may be used on a sighting device without the secondary reflective sight component 183 and vice-versa.

The above-described arrangement is also advantageous since the light emitting elements, including the entire length of the fiber optics, are protected from snags on branches while walking through the woods or other incidental damage during use. This is an improvement over prior art devices that have exposed fiber optic sighting elements or pins.

Figure 12:
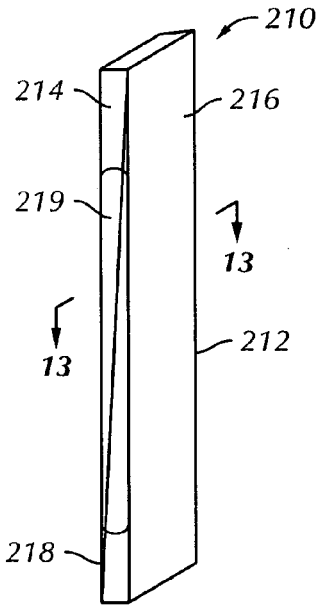
FIG. 12 is a right rear perspective view of a reflective sight component in accordance with a further embodiment of the invention.
Figure 13:
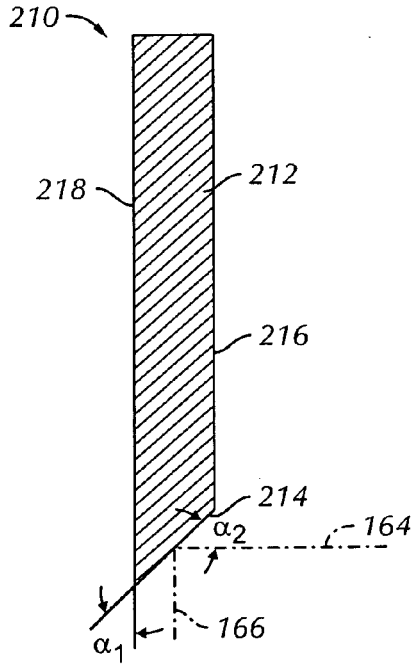
FIG. 13 is a sectional view of the reflective sight component taken along line 13-13 of FIG. 12.

Turning now to FIGS. 12 and 13, a primary reflective sight component 210 in accordance with a further embodiment of the invention is illustrated. The sight component 210 includes a blade 212 with a rearwardly facing flat reflective surface 214 that extends between a right side surface 216 and a left side surface 218 of the blade 212 to face a user of the illuminated sighting device 10. Preferably, the reflective surface 214 comprises a layer or coating 219 of material for enhancing the image of the incident sight dots 126-132. When the reflective surface 214 is constructed of a highly polished metal, the coating 219 may be a protective layer to prevent surface degradation when exposed to the environment. When the blade 212 is constructed of a plastic material, the coating 219 may be a reflective layer of silver, gold, copper or other reflective material or combinations thereof.

As with the reflective sight component 89, the reflective surface 214 of the reflective sight component 210 extends at a first angle $\alpha_1$ with respect to the left side surface 218 and a second angle $\alpha_2$ with respect to the first line of sight 164 (shown in broken line) of the illuminated ends or light emitting elements 100, 102 (FIG. 2). Preferably the first and second angles are approximately 45° so that a user can view the sight dots 126-132 incident on the reflective surface 158 along the second line of sight 166 (shown in broken line) from the reflective surface. However, it will be understood that the first and second angles may be different and/or vary over a wide range of values depending on the particular sight configuration and/or the aiming stance of a user.

The reflective sight component 210 can be connected to the sight frame 88 using any attachment means such as bolts, adhesive, welding, heat staking, and so on, depending on the type of material used for both the reflective sight component and the sight frame.

Figure 14:
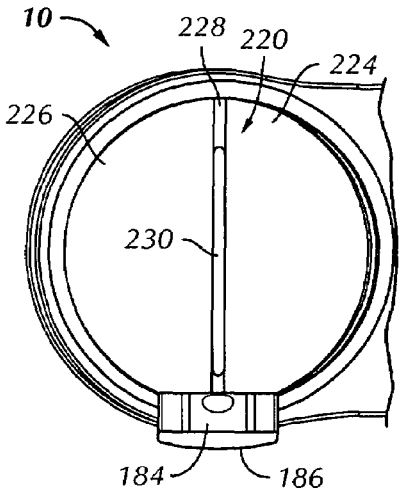
FIG. 14 is a rear elevational view of a sight assembly in accordance with a further embodiment of the invention.
Figure 15:
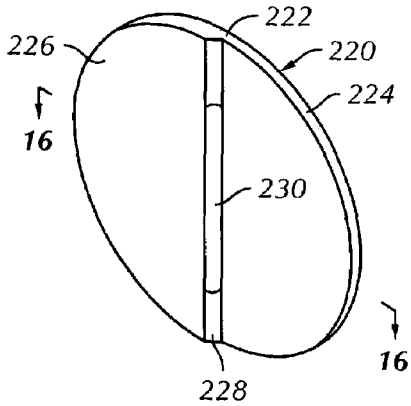
FIG. 15 is a right rear perspective view of a reflective sight component of the FIG. 14 sight assembly.
Figure 16:
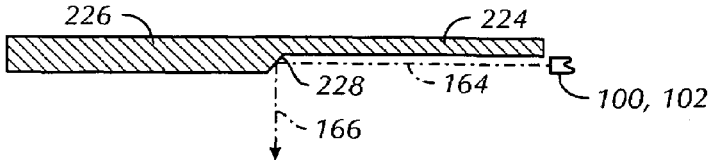
FIG. 16 is a sectional view of the reflective sight component taken along line 16-16 of FIG. 15 and showing the direction of light travel.

Referring now to FIGS. 14-16, a primary reflective sight component 220 in accordance with a further embodiment of the invention is illustrated. The sight component 220 includes a disk or lens 222 mounted in the sight window 91 of the sight frame 88 through well-known attachment means. The lens 222 is preferably constructed of a transparent material, such as glass, plastic or the like and includes a relatively thin section 224, a relatively thick section 226 and a rearwardly facing flat reflective surface 228 that extends between the thin and thick sections to face a user. The angular orientation of the reflective surface 228 is preferably similar to the angular orientation of the reflective surfaces previously described. Preferably, the reflective surface 228 comprises a reflective layer or coating 230 of silver, gold, copper, a dichroic and/or partially reflective coating or other reflective material or combinations thereof, the properties of which depend on the selected color of the incident sight dots (not shown) from the light emitting elements previously described, such as red, blue, green, etc., as well as the desired intensity of the incident sight dots with respect to the relative ambient light intensity. It will be understood that although the lens 222 is shown as a generally flat disk, it may be curved and/or used in conjunction with other coatings, lenses, and/or lens configurations to produce a particular visual effect, such as increased magnification of the target, or to reduce or prevent unwanted visual effects as is well known.

In accordance with yet a further embodiment of the invention, the relatively thin section 224 may be eliminated while maintaining the reflective surface 228 so that a user has a clear, unobstructed view of the distal target.

In accordance with another embodiment, the thick section may be replaced with another relatively thin section so that the reflective surface 228 extends as an angled protrusion from both thin sections.

Figure 17:
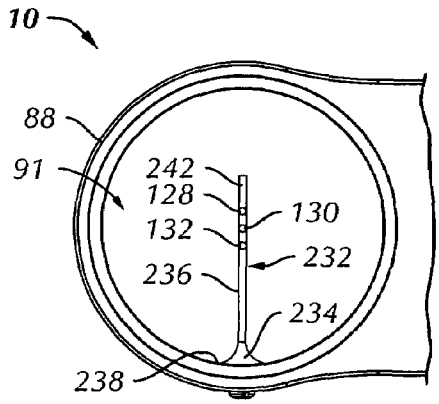
FIG. 17 is a rear elevational view of a sight assembly in accordance with a another embodiment of the invention.
Figure 18:
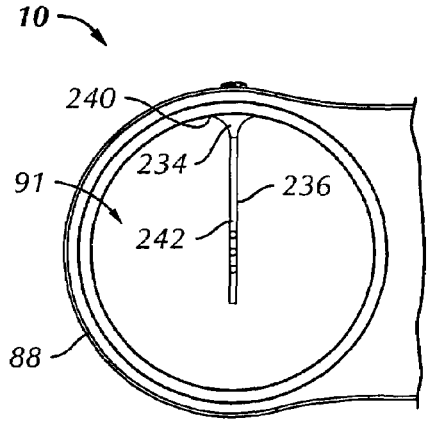
FIG. 18 is a rear elevational view of a sight assembly in accordance with a yet a further embodiment of the invention.
Figure 19:
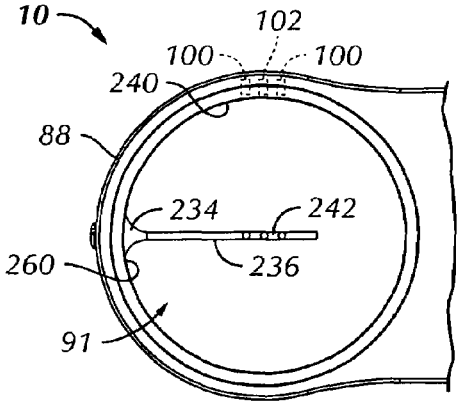
FIG. 19 is a rear elevational view of a sight assembly in accordance with a further embodiment of the invention.

Referring now to FIGS. 17-19, a primary reflective sight component 232 in accordance with a further embodiment of the invention is illustrated. The reflective sight component 232 is similar in construction to the sight component 89, with the exception that only a single mounting head 234 is connected to a shortened blade 236 for mounting the reflective sight component 232 at a single location on the sight frame 88 and preferably within the sight window 91. The reflective sight component 236 may be mounted to a lower end 238 of the sight frame 88 so that the blade extends upwardly as shown in FIG. 17, an upper end 240 of the sight frame as shown in FIG. 18 so that the blade extends downwardly as shown in FIG. 18, or an intermediate position on the sight frame so that the blade extends horizontally as shown in FIG. 19. In the FIG. 19 embodiment, the light emitting elements 100, 102 may be positioned at the upper end 240, preferably equidistant from the reflective surface 242, for projecting sight dots onto the reflective surface. It will be understood that the sight blade may be mounted at any angular position around the sight frame 88.

The shortened blade 236 includes a shortened, rearwardly facing reflective surface 242 that is preferably oriented at a 45° angle, as described with the previous embodiments, so that one or more sight dots 128, 130, 132 created by one or more light emitting elements can be viewed by a user when the bow is in the aiming position. It will be understood that the reflective sight component 232 can be mounted to the sight frame 88 through other attachment means as previously described with respect to the FIGS. 12 and 13 embodiment. It will be further understood that a shortened reflective surface 242 may be formed on the disk or lens 222 of the embodiment shown in FIGS. 14-16.

It will be understood that the term "preferably" as used throughout the specification refers to one or more exemplary embodiments of the invention and therefore is not to be interpreted in any limiting sense. In addition, terms of orientation and/or position as may be used throughout the specification, such as lower, upper, forward, rearward, vertical, horizontal, right, left, as well as their respective derivatives and equivalent terms denote relative, rather than absolute orientations and/or positions.

It will be appreciated by those skilled in the art that changes could be made to the embodiments described above without departing from the broad inventive concept thereof. By way of example, any of the above-described reflective sight components, as well as their equivalents, and/or the light emitting elements, can be contained within a hermetically sealed environment, e.g. between clear lenses mounted on the front and rear of the sight frame and filled with an inert gas, such as Nitrogen. In this manner, the integrity of the reflective surface and/or light emitting elements can be protected from the environment, including dirt, dust, fingerprints, moisture, and so on.

It will be understood, therefore, that this invention is not limited to the particular embodiments disclosed, but also covers modifications within the spirit and scope of the present invention as defined by the appended claims.

I claim:

1. An illuminated sighting device comprising:

a sight frame defining a sight window with a first central axis;

a reflective sight component mounted on the sight frame and having an elongate reflective surface located in the sight window for facing a user and at least one side surface facing the sight frame, the elongate reflective surface being oriented at an acute angle with respect to the side surface and extending along a second central axis perpendicular to the first central axis; and a first light emitting element arranged for projecting a first sight dot onto the reflective surface for view by a user during aiming.

2. An illuminated sighting device according to claim 1, and further comprising a second light emitting element arranged for projecting a second sight dot onto the reflective surface for view by a user during aiming, the first and second light emitting elements being approximately equally spaced from the reflective surface.

3. An illuminated sighting device according to claim 2, wherein the first light emitting element is arranged above the second light emitting element so that the first sight dot is incident on the reflective surface above the second sight dot.

4. An illuminated sighting device according to claim 3, wherein the reflective surface comprises a planar surface.

5. An illuminated sighting device according to claim 4, wherein a width of the reflective surface is approximately equal to a width of the incident sight dots so that at least a substantial portion of the sight dots can only be seen by the user when the sighting device is properly aligned with the user during aiming and at least the substantial portion of the sight dots cannot be viewed by the user when the sighting device is not properly aligned during aiming.

6. An illuminated sighting device according to claim 2, wherein at least one of the light emitting elements comprises at least one of a light emitting diode and an end of at least one light collector, the at least one light emitting element arranged for projecting radiant energy toward the reflective surface along an axis perpendicular to the first and second central axes when the sighting device is properly oriented for aiming.

7. An illuminated sighting device according to claim 6, wherein at least one of the light emitting elements comprises the end of the at least one light collector, the at least one light collector comprising a fluorescent-doped fiber optic.

8. An illuminated sighting device according to claim 7, wherein the at least one light collector wraps around the sight frame.

9. An illuminated sighting device according to claim 2, wherein the first and second light emitting elements are independently adjustable to change the position of the first and second sight dots along the reflective surface.

10. An illuminated sighting device according to claim 1, wherein a width of the reflective surface is approximately equal to a width of the first incident sight dot so that at least a substantial portion of the sight dot can only be seen by the user when the sighting device is properly aligned about a first axis with respect to the user during aiming and at least the substantial portion of the sight dot cannot be viewed by the user when the sighting device is not properly aligned during aiming.

11. An illuminated sighting device according to claim 1, wherein the reflective sight component comprises an elongate blade with said at least one side surface comprising a pair of side surfaces that extend in a direction at least substantially parallel with the first central axis, with the elongate reflective surface being formed on a rear edge of the blade between the side surfaces, the rear edge of the blade having a width that is much smaller than a width of the sight window to thereby provide a substantially unobstructed view of a distant target through the sight window.

12. An illuminated sighting device according to claim 11, wherein the elongate blade extends across the sight window between an upper frame section and a lower frame section of the sight frame.

13. An illuminated sighting device according to claim 11, wherein the sight frame includes upper and lower frame sections; and further wherein the elongate blade extends from one of the upper and lower frame sections and terminates within the sight window without extending to the other of the upper and lower frame sections.

14. An illuminated sighting device according to claim 1, wherein the reflective sight component comprises a lens mounted on the sight frame within the sight window, the reflective surface being formed as a flat surface that extends at the acute angle with respect to the side surface of the lens.

15. An illuminated sighting device according to claim 1, wherein the reflective surface is oriented at an angle of approximately 45 degrees with respect to the at least one side surface.

16. An illuminated sighting device comprising:

a sight frame defining a sight window with a first central axis;

a primary reflective sight component having a first elongate reflective surface located in the sight window and extending across the sight window along a second central axis perpendicular to the first central axis for facing a user when the illuminated sighting device is in an aiming position with respect to the user;

a first light emitting element arranged for projecting a first sight dot onto the first reflective surface for view by the user during aiming;

a secondary reflective sight component located on the sight frame and having a second elongate reflective surface being non-parallel with the first elongate reflective surface and extending along a third axis perpendicular to the first and second axes for facing the user when the illuminated sighting device is in the aiming position; and a second light emitting element arranged for projecting a second sight dot onto the second reflective surface for view by a user during aiming to thereby orient the sighting device to a correct aiming position.

17. An illuminated sighting device according to claim 16, wherein the first and second reflective surfaces are rectangular-shaped with a length of the second reflective surface being greater than a width of the first reflective surface so that the second sight dot is viewable over a wider angle than the first sight dot.

18. An illuminated sighting device according to claim 17, wherein the width of the first and second reflective surfaces is approximately equal to a width of the first and second incident sight dots, respectively, so that at least a substantial portion of the first and second sight dots can only be seen by the user when the sighting device is properly aligned about first and second axes with respect to the user, the second axis being perpendicular to the first axis.

19. An illuminated sighting device according to claim 18, and further comprising a bubble level connected to the sighting device for aligning the sighting device about a third axis perpendicular to the first and second axes.

20. An illuminated sighting device comprising:

a sight frame defining a sight window;

a reflective sight component located in the sight frame and having a reflective surface for facing a user; and at least one light emitting element arranged for projecting at least one sight dot onto the reflective surface for view by a user during aiming, a width of the reflective surface being narrower than the sight window to thereby provide a substantially unobstructed view of a distant target through the sight window and being approximately equal to a width of the incident sight dot so that at least a substantial portion of the sight dot can be viewed by the user when the sighting device is properly aligned with the user during aiming and at least the substantial portion of the sight dot cannot be viewed by the user when the sighting device is not properly aligned during aiming.

21. An illuminated sighting device according to claim 20, wherein the reflective surface is a thin, elongate reflective surface that extends at least substantially perpendicular to a line of sight between the user and a distal target and is oriented at an acute angle with respect to the line of sight when the illuminated sighting device is in an aiming position with respect to the user.

22. An illuminated sighting device according to claim 21, wherein the thin, elongate reflective surface extends along a vertical axis when the sighting device is in the aiming position.

23. An illuminated sighting device according to claim 20, wherein the sight frame has an upper frame section and lower frame section defining the sight window.

24. An illuminated sighting device according to claim 23, wherein the reflective sight component comprises an elongate blade with the reflective surface being formed on a rear edge of the blade.

25. An illuminated sighting device according to claim 24, wherein the elongate blade extends across the sight window between the upper frame section and lower frame section such that the elongate blade extends along a vertical axis when the sighting device is in an aiming position with respect to a user.

26. An illuminated sighting device according to claim 24, wherein the elongate blade extends from one of the upper and lower frame sections and terminates within the sight window.

27. An illuminated sighting device according to claim 20, wherein the reflective sight component comprises a lens mounted on the sight frame within the sight window, the reflective surface being formed as a flat surface that extends from the lens at an acute angle with respect to a plane parallel with the lens.

28. An illuminated sighting device according to claim 20, and further comprising a mounting bracket connected to the sight frame for mounting the illuminated sighting device to a bow.

* * * * *

UNITED STATES PATENT AND TRADEMARK OFFICE
Certificate

Patent No. 7,574,810 B1 Patented: August 18, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Paul LoRocco, Dallas, TX (US); and John Estridge, Plano, TX (US).

Signed and Sealed this First Day of July 2014.

LISA CAPUTO
*Supervisory Patent Examiner*
Art Unit 2856
Technology Center 2800